US005193332A

United States Patent [19]

Kriegler et al.

[11] Patent Number: 5,193,332

[45] Date of Patent: Mar. 16, 1993

[54] SPINNING OR TWISTING DEVICE WITH A PIPE SHAPED ELEMENT CAPABLE OF BEING SUBJECTED TO NEGATIVE PRESSURE

[76] Inventors: Albert Kriegler, Ziegeleistrasse 5, D-8069 Rottenegg; Rudolf Becker, Julius-Leber-Strasse 8; Rupert Karl, Thomastr. 13 a, both of D-8070 Ingolstadt; Johann Halbritter, Ulmenstr. 14, D-8071 Wettstetten, all of Fed. Rep. of Germany

[21] Appl. No.: 780,528

[22] Filed: Oct. 18, 1991

Related U.S. Application Data

[63] Continuation of Ser. No. 547,791, Jul. 2, 1990, abandoned.

[30] Foreign Application Priority Data

Jul. 4, 1989 [DE] Fed. Rep. of Germany ..... 3921911

[51] Int. Cl.[5] ..... D01H 4/00; D01H 4/50

[52] U.S. Cl. ..... 57/263; 57/301; 57/305; 57/353; 57/400; 57/405; 57/417

[58] Field of Search ..... 57/301, 304–305, 57/400, 405–406, 263, 417, 352–353

[56] References Cited

U.S. PATENT DOCUMENTS

| | | | |
|---|---|---|---|
| 3,355,868 | 12/1967 | Civrny et al. | 57/263 |
| 3,643,414 | 2/1972 | Prochazka et al. | 57/405 |
| 3,718,296 | 2/1976 | Mahoney et al. | 57/353 X |
| 3,841,074 | 10/1974 | Wachendorf et al. | 57/353 X |
| 4,023,336 | 5/1977 | Krusche et al. | 57/263 |
| 4,438,624 | 3/1984 | Maver et al. | 57/263 X |
| 4,481,766 | 11/1984 | Kurushinia et al. | 57/352 X |
| 4,494,371 | 1/1985 | Morita et al | 57/263 |
| 4,642,981 | 2/1987 | Shimawo | 57/417 |
| 4,757,678 | 7/1988 | Stawlecker | 57/263 |
| 4,891,933 | 1/1990 | Raaschl | 57/263 X |

FOREIGN PATENT DOCUMENTS

| | | | |
|---|---|---|---|
| 2128648 | 5/1984 | United Kingdom | 57/400 |

*Primary Examiner*—Daniel P. Stodola
*Assistant Examiner*—William Stryjewski
*Attorney, Agent, or Firm*—Dority & Manning

[57] ABSTRACT

A spinning or twisting device in which a yarn is to be back-fed into the bore of a pipe-shaped element subjected to negative pressure in order to repair a yarn break. This pipe-shaped element is made in form of a yarn draw-off pipe of an open-end spinning device or as part of a pneumatic twisting device.

A presenting device is moved over and beyond the pipe-shaped element into a yarn inserting position. The end of the pipe-shaped element towards the moving path of the presenting device is provided with a nozzle which is provided, in relation to the bore, on its side towards the yarn inserting position of the presenting device with a yarn support, and on its side away from the yarn inserting position with a yarn insertion groove, oriented in the direction of movement of the presenting device. The bottom of the yarn insertion groove is at a greater distance from the moving path of the presenting device than the yarn support.

27 Claims, 5 Drawing Sheets

SPINNING OR TWISTING DEVICE WITH A PIPE SHAPED ELEMENT CAPABLE OF BEING SUBJECTED TO NEGATIVE PRESSURE

This is a continuation of application Ser. No. 07/547,791, filed Jul. 2, 1990, now abandoned.

BACKGROUND OF THE INVENTION

The instant invention relates to a spinning or twisting device with a pipe-shaped element, subjected to negative pressure, in the bore of which a yarn is back-fed, and with a presenting device movable over the pipe-shaped element into a yarn inserting position.

More specifically, in a prior art device, a yarn cut to a preselected length is brought by means of a presenting device to a yarn draw-off pipe by means of such a device provided for a rotor spinning machine (see German Patent No. 34 17 331 Al), where the presenting device is swiveled so far over and beyond the yarn draw-off pipe that the yarn end is located above the outlet of the yarn draw-off pipe. Negative pressure, produced by the negative spinning pressure, is present in the yarn draw-off pipe. To enable the yarn to follow the suction air stream thus produced into the yarn draw-off pipe, the presenting device is now swiveled back. Due to outside influences, however, the yarn end may not be located precisely above the outlet of the yarn draw-off pipe so that back-feeding of the yarn end into the yarn draw-off pipe is not possible.

SUMMARY OF THE INVENTION

It is, therefore, the object of the instant invention to provide a spinning device so that reliable insertion of the yarn into the yarn draw-off pipe or other pipe-shaped element of the spinning device, e.g., into the pneumatic twisting element of an air spinning device, is ensured.

This object is attained through the invention in that the end of the pipe-shaped element near the moving path of the presenting device is equipped with a nozzle having a yarn support related to the bore of the pipe-shaped element on its side near the yarn inserting position of the presenting device, and with a yarn insertion groove oriented in the sense of movement of the presenting device on its side away from the yarn inserting position. The bottom of the groove is at a greater distance from the moving path of the presenting device than the yarn support. Due to this design the yarn end in the yarn inserting position of the presenting device extends freely outward from the yarn support and follows the air stream sucked into the pipe-shaped element without having to overcome great frictional influences, or entirely without frictional influences. In this way the yarn, safely and simply, enters the nozzle of the pipe-shaped element so that when the presenting device moves back the yarn end can be sucked back so far into the pipe-shaped element that it is securely held there by the negative pressure prevailing in the pipe-shaped element upon being released by the presenting device.

To reduce friction it is possible to have the yarn insertion groove verge via a convex surface into the bore of the pipe-shaped element. It has been shown that it is especially advantageous for the edge radii of the yarn-deflecting edges to measure between 0.5 and 1.5 mm.

When the free yarn end extends slightly beyond the yarn insertion groove, the friction required to deflect the yarn end for insertion into the nozzle of the pipe-shaped element is so minimal as to be negligible. Nevertheless, it is especially advantageous, in particular for certain materials or with relatively weak negative pressures in the pipe-shaped element, if the yarn insertion groove length is at least equal to the length of the yarn end extending beyond the yarn support when the presenting device is in the yarn inserting position. This ensures that the free yarn end is without support within the range of the suction air stream of the pipe-shaped element of the spinning device and able to enter the bore of the pipe-shaped element without having to overcome frictional forces.

In order to also eliminate friction between the yarn end and the bottom of the yarn insertion groove, provisions are made in one embodiment of the yarn insertion groove that it is given a concave curved bottom extending essentially concentrically with the end of the yarn support towards the yarn insertion groove.

In its way to the nozzle of the pipe-shaped element the free yarn end is not kept under tension. To ensure, nevertheless, that the end reaches the range of the suction air stream prevailing in the nozzle area of the pipe-shaped element, provisions are made in a further embodiment of the invention for the yarn insertion groove to be preceded (in relation to the movement of the presenting device towards its yarn inserting position) by a yarn guide feeding the yarn end to the yarn insertion groove.

The design of the yarn guide may vary. In a preferred embodiment, the nozzle is provided with a wall upstream of the yarn insertion groove on its side away from the presenting device in the yarn inserting position, the wall extending essentially at a right angle to the moving path of the presenting device, and the yarn guide is made in form of a notch.

In another embodiment of the invention the presenting device is provided with a guide on its side towards the nozzle, the maximum outer width of which is smaller than the maximum inner width of the notch and which can be moved through the notch as the presenting device moves into its yarn inserting position.

The notch is preferably asymmetric, and of such configuration that its imaginary center line extends increasingly further away from the moving path of the presenting device while coming increasingly nearer to the pivot axis of the element. This causes the yarn to be drawn increasingly deeper into the notch as the presenting device pivots into its yarn inserting position and is, thus, held securely in such a position that the yarn enters the yarn insertion groove. To ensure that the yarn remains in the groove, the notch edge towards the pivot axis of the presenting device forms an angle with the moving plane of the presenting device which, measured from the inside of the notch, which is not less than 85°. However, this angle is preferably greater than 90°. Alternatively, or in addition, the notch edge towards the swivel axis of the presenting device is undercut for that purpose.

In another embodiment of the invention the yarn guide is made in form of a yarn guiding groove extending along the moving path of the presenting device. This guiding groove forcibly orients the yarn end in the direction of the yarn insertion groove.

To facilitate the introduction of the yarn into the guiding groove, the latter is provided with a widening on its side away from the yarn inserting position of the presenting device.

Depending on the fiber material used, the free yarn end extending from the presenting device deviates to some extent from the desired length. To ensure, nevertheless, that the yarn safely enters the bore of the pipe-shaped element even though it may lie on the nozzle side away from the yarn inserting position of the presenting device, it is advantageous for the guiding groove to be provided with a bottom that is a small distance from the moving path of the presenting device on its side away from the yarn inserting position of said presenting device. The guiding groove is thus sloped in the direction of the bore of the pipe-shaped element, thus decreasing friction with the yarn, when the free yarn end extends beyond the yarn insertion groove. It is especially advantageous if the bottom of the guiding groove, in that case, extends essentially along the imaginary connecting line between the guiding groove end away from the yarn inserting position of the presenting device and the nozzle of the pipe-shaped element towards the moving path of said presenting device.

In another embodiment of the invention, the guiding groove extends beyond the yarn insertion groove in the direction of the presenting device in the yarn inserting position, whereby the yarn support is part of the guiding groove. In this way the yarn end is guided before and after the bore of the pipe-shaped element of the spinning device.

When the presenting device can be pivoted around an axis it is advantageous for the yarn to follow a path between the yarn guide and the presenting device in the yarn inserting position in such manner as to ensure that the yarn will be located above the yarn insertion groove in spite of the curved path of the presenting device. For that purpose, it is possible to ensure, in an embodiment of the device according to invention, that the end towards the yarn insertion groove of the yarn guide preceding the yarn insertion groove is at a greater distance from the pivot axis of the presenting device than the end of the yarn insertion groove towards the yarn guide. In that case, it is preferable for the connecting line between yarn guide and the presenting device to intersect a plane formed by the end of the pipe-shaped element towards the presenting device and the yarn insertion groove in the area of the yarn insertion groove.

To be able to hold the yarn in its desired course with the presenting device mounted so as to be capable of pivoting, it is possible to provide for the yarn guide preceding the yarn insertion groove to support, on its side towards the pivot axis of the presenting device, an elastic or elastically mounted element extending to the moving path of the presenting device.

It is often desirable to locate the yarn monitor as close as possible to the spinning element. In order to make this possible with the invention, an embodiment of the invention provides for the nozzle to be provided with a lateral opening through which the free end of a pivoting yarn feeler extends into the open space the bottom of which the yarn insertion groove is located. The yarn feeler extends in the direction of the yarn support beyond the bore of the pipe-shaped element and receives the free end of the yarn feeler between the bore and the yarn support, whereby the recess has a depth, with respect to the yarn support, that is greater than the sum of the thickness of the diameter of the yarn feeler and of its distance from the bottom of the recess. This ensures that the yarn goes to the side away from the presenting device and thereby reaches the desired side of the yarn feeler for the subsequent spinning process when it is presented in front of the nozzle of the pipe-shaped element.

In another embodiment of such a device, according to the invention, the recess is in the form of a chamber which is covered by a wall on its side towards the moving path of the presenting device, the wall being intersected by the guiding groove extending on both sides of the yarn insertion groove. This ensures especially reliable guidance, even in combination with a yarn motor.

The stronger the suction air stream prevailing in the pipe-shaped element, the better is the introduction of the yarn end into the bore of said pipe-shaped element. In order to avoid having to dispose of an especially strong suction air stream and, nevertheless, achieve an intensive action of this suction air stream upon the yarn end, the nozzle is provided with a cover. In this manner, the intensive action upon the yarn end is achieved despite relatively slight negative pressure in the pipe-shaped element. In that case, the cover is controllable by the presenting device as a function of the latter's position.

It is often desirable to secure the yarn for a rather long time period in the area of the nozzle of the pipe shaped element. To achieve this, the yarn support of the nozzle is made in the form of a clamping element in another embodiment of the device according to the invention. It is possible to move a clamping element that is essentially parallel to the moving path of the presenting device towards the first clamping element.

In order to reduce frictional forces, at least that part of the nozzle which receives the yarn insertion groove is made of a synthetic material that is not statically chargeable.

Because of manufacturing imperatives, the nozzle is best not made in one piece with the pipe-shaped element of the spinning device but is interlockingly connected to the pipe-shaped element and/or the cover covering the spinning or twisting device, it being possible to establish this connection by means of a snap-in connection.

The invention can be used with different types of spinning devices. In an embodiment, the spinning device is an open-end spinning device, with the pipe-shaped element consisting of the yarn draw-off pipe. The object of the invention can, however, also be used with spinning devices in which the spinning element is a pneumatic twisting element. In this case the pipe-shaped element is part of the pneumatic twisting element.

The invention is simple in construction, is space-saving and can easily be installed on existing machines. It ensures reliable presentation of the yarn end to the pipe-shaped element and thus ensures its smooth insertion there, so that reliability of the subsequent yarn back-feeding process is increased.

BRIEF DESCRIPTION OF THE DRAWINGS

Further details of the invention shall be explained hereinbelow through embodiments and with the help of the drawings, in which.

DETAILED DESCRIPTION OF THE INVENTION

The invention shall be explained hereinafter, for simplicity's sake, as used with an open-end spinning machine which uses spinning rotors, friction spinning elements, electrical or electrostatic or purely pneumatic spinning elements as its spinning devices.

Figure 1:
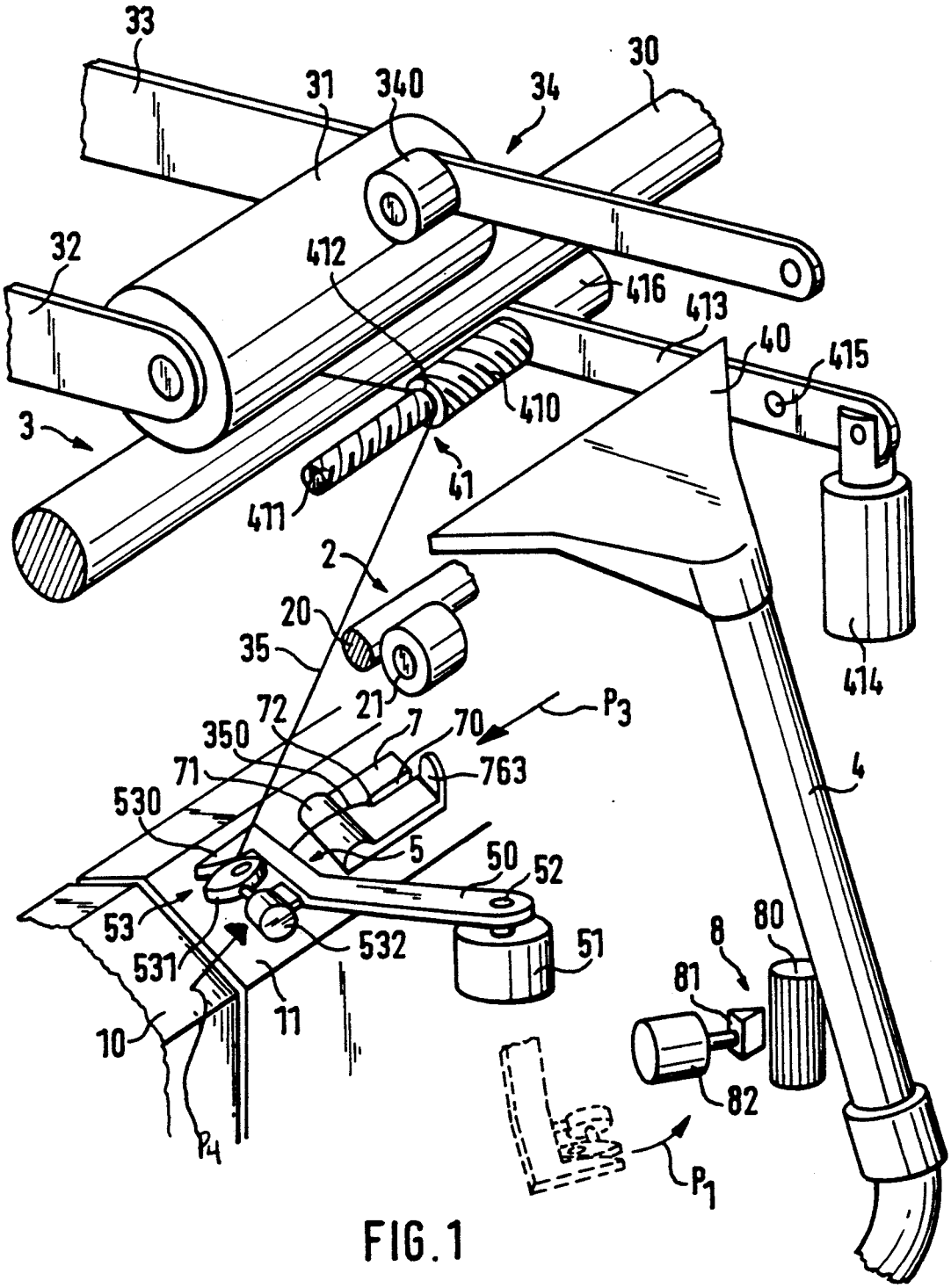
FIG. 1 is a perspective view of an open-end spinning station with the device according to the invention.

The open-end spinning machine is represented in FIG. 1, and only those parts which are necessary to understand the invention are shown. In this machine, a plurality of open-end spinning devices are installed one next to the other, and of these, FIG. 1 only shows covers 10 and 11 of two adjoining spinning stations. Covers 10 and 11 each cover a spinning device each of which is equipped in the usual manner (and therefore not shown) with an open-end spinning element, e.g., a spinning rotor with a fiber collection surface.

An opening device (not shown), to which a fiber sliver is fed by means of a feeding device (not shown), precedes the open-end spinning element. The opening device opens the fiber sliver into individual fibers which are fed to the open-end spinning element and there deposited on the fiber collection surface under the effect of a suction air stream (negative spinning pressure). The fibers are incorporated into the end of a yarn end and are drawn off in form of a yarn 35 through a yarn draw-off pipe 12 (see FIG. 2) by means of a pair of draw-off rollers 2 consisting in the usual manner of a driven draw-off roller 20 and a pressure roller 21 pressed elastically against it. The draw-off pipe has a mouth 12*a* and axis 12*b* extending therethrough. The drawn-off yarn 35 is conveyed to a winding deice 3 with a driven winding roller 30 on which a bobbin 31 lies during the spinning operation. The bobbin 31 is supported in a known manner between two bobbin arms 32 and 33 by means of which the bobbin 31 is brought to bear against the winding roller 30 or is lifted away from it.

Auxiliary driving devices 34 equipped with a driven auxiliary roll 340 can be assigned to the bobbin 31. As such auxiliary driving devices are known, the conventional pivot drive, as well as the driving devices, therefore, are not shown in the figures for the sake of clarity.

To be able to suck the yarn end produced by a yarn breakage from bobbin 31 when such breakage occurs, a suction pipe 4, which can be moved towards the bobbin 31, is provided. This suction pipe 4 has a nozzle 40 which extends in the receiving position near the bobbin 31 parallel to its circumferential line over the entire length of bobbin 31. The suction pipe 4 is provided with a longitudinal slit (not shown) on its side towards the winding device 3 and the spinning device (of which only the cover 11 is shown) through which the yarn 35 can emerge from the suction pipe 4 when the latter is pivoted back into its position as shown in FIG. 1.

In the path of the yarn 35 emerging from the suction pipe 4 is a centering device 41. In the embodiment shown, the centering device consists of a driven spindle with two length segments 410 and 411 of different diameters between which a circumferential groove 412 is located. The centering device 41 is supported on a pivoting arm 413 which can be brought by a drive 414 into different positions around axis 415.

The segment 410 near the arm 413 has a greater diameter than the segment 411 on the free end of the centering device 41. In addition, the two segments 410 and 411 are provided with threads going in opposite directions. The centering device 41 can be driven, as desired, in either one of the two directions of rotation by means of a drive 416.

A presenting device 5 can be moved towards the yarn 35 extending from suction pipe 4 via centering device 41 to bobbin 31. The presenting device 5 essentially consists of a pivoting arm 50 by means of which a pivot drive 51 can be pivoted around axis 52. On it free end away from the axis 52, the presenting device 5 is equipped with a controllable yarn clamp 53 which, according to FIG. 1, consists of a clamping jaw 530 rigidly attached to the arm 50 and of a clamping jaw 531 which can be moved against it. This clamping jaw 531 is assigned a drive 532, for instance, in the form of a solenoid.

The presenting device 5 can be pivoted in the direction of arrow $P_1$ over the cover 11, over and past the yarn draw-off pipe 12 into the position shown in . FIG. 1, i.e., the yarn inserting position, in order to present the yarn 35 to the yarn draw-off pipe 12. The yarn inserting position is to be understood here to be the position of presenting device 5 in which the yarn end 350 of the yarn 35 is situated above the nozzle of the yarn draw-off pipe 12 and can be introduced into pipe 12.

Figure 2:
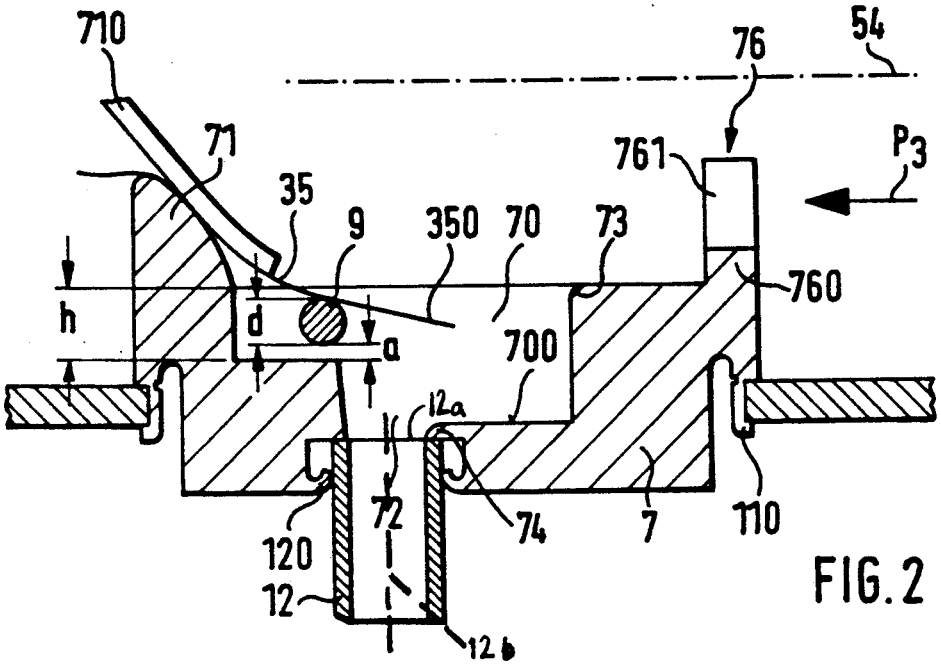
FIG. 2 is a longitudinal sectional view of a nozzle according to the invention.

The yarn draw-off pipe 12 is provided with a nozzle 7 on its end towards moving path 54 (see FIG. 2) of the presenting device 5. The nozzle is provided on its side away from the yarn inserting position of the presenting device 5 (in relation to the bore 72 of yarn draw-off pipe 12) with a yarn insertion groove 70, and on its side towards the yarn inserting position with a yarn support 71. As can be seen in FIG. 2, the bottom 700 of the yarn insertion groove 70 is at a greater distance from the moving path 54 of presenting device 5 than the yarn support 71. The reason for this shall be explained further below in greater detail. The groove 70 extends perpendicular to the axis 12*b* of the mouth 12*a*.

The yarn insertion groove 70 is essentially oriented in the moving direction (arrow $P_3$) of the presenting device 5.

A cutting device 8 is provided in the path of the yarn, between the end of the longitudinal slit of suction pipe 4 away from bobbin 31 and the centering device 41 in such manner that a yarn 35 can be cut off on the side of yarn clamp 53 away from bobbin 31.

In the embodiment shown in FIG. 1 the cutting device 8 consists of a roller 80 which serves as an anvil and with which a cutting edge 81, associated for that purpose with a drive 82, interacts. For reason of clarity the cutting device 8 has been shown in FIG. 1 turned away slightly from its actual position.

Appropriate drive and control elements are, of course, provided for the different elements described, and these can be of a design in general use, so that they are not shown in the figures for the sake of clarity. The drive and control elements are controlled by a control device which is not shown and which also controls the entire piecing process. Other conventional parts, such as for example a yarn guide, a yarn tension compensating hoop, etc. are omitted in order to simplify the illustration in the drawings.

The device's structure having been described, its operation shall now be explained in further detail:

During normal spinning operation the yarn 35, spun in the normal manner in the spinning device, is fed by means of the draw-off rollers 2 to bobbin 31 driven by roller 30 and is wound up on the bobbin, with yarn 35 being held under constant tension by means of yarn tension compensating means (not shown) and is distributed pendulum-fashion by a yarn guide (not shown).

If yarn breakage occurs, the open-end spinning device is stopped in the known manner so that fibers can no longer reach the fiber collection surface of the open-end spinning element. Furthermore, the bobbin 31 is lifted from winding roller 30 by known means which are, therefore, not shown, so that bobbin 31 is also stopped.

For the piecing of yarn 35 the open-end spinning element is cleaned in a known manner, whereby it is as a rule temporarily braked, possibly even to a full stop.

To be able to back-feed the end of the torn or broken yarn 35 from bobbin 31 of winding device 3 to the fiber collection surface of the open-end spinning element, the end must be drawn off from bobbin 31. For that purpose the bobbin 31, which is lifted from winding roller 30, is then contacted by the auxiliary driving roller 340 of the driving device 34. The auxiliary driving roller 340 is driven by conventional means in a direction that is opposite to that of normal winding. Furthermore, in coordination with the movement bringing the auxiliary driving device 34 into action, the suction pipe 4 is pivoted against bobbin 31 and a negative pressure is produced in it. The yarn end is thereby sucked into the suction pipe 4. When a sufficient length of yarn 35 has entered suction pipe 4 so that it is securely held by the suction air stream prevailing here, suction pipe 4 is pivoted away from bobbin 31, whereby a section of yarn 35 emerges from the suction pipe 4 through its longitudinal slit, but is still held in the suction pipe 4 by its free end.

Yarn 35, emerging from suction pipe 4, reaches the centering device 41 which is then driven so that yarn 35 enters its circumferential groove 412. Yarn 35 thereby follows a defined yarn path between the slit end of suction pipe 4 away from bobbin 31 and the centering device 41.

The presenting device 5 is then at first in a starting position 5a. It is now pivoted in the direction of arrow $P_1$. In this process the yarn clamp 53 crosses the yarn path of yarn 35 which extends from the slit end in suction pipe 4 to the centering device 41, seizes and clamps said yarn 35 between its clamping jaws 530 and 531 which can be first opened to grasp yarn 35, and then be closed when yarn 35 has been received.

The presenting device 5 then reaches its cutting position, whereby yarn 35 enters the effective range of the cutting device 8. The cutting device is now actuated. Yarn 35, which is cut in this manner has, therefore, a defined yarn length between yarn clamp 53 and cutting device 8.

Once yarn 35 has been cut to this defined yarn length the presenting device 5 is moved on towards the open-end spinning device (see cover 11) until it is in its yarn inserting position shown in FIG. 1, whereby the yarn clamp 53 is guided over the nozzle of yarn draw-off pipe 12. The free yarn end 350 of the shortened yarn 35 thereby enters the yarn insertion groove 70 extending parallel to the moving direction of the presenting device 5 (see arrow $P_3$), thus ensuring that yarn 35 enters the range of the suction air stream produced by the negative spinning pressure in the yarn draw-off pipe 12. Yarn 35 rests on the yarn support 71 between the yarn insertion groove 70 and the presenting device 5 in yarn inserting position.

When presenting device 5 has reached its yarn inserting position (see FIG. 1), yarn end 350 extends from the yarn clamp 53 to above the yarn insertion groove 70.

Figure 3:
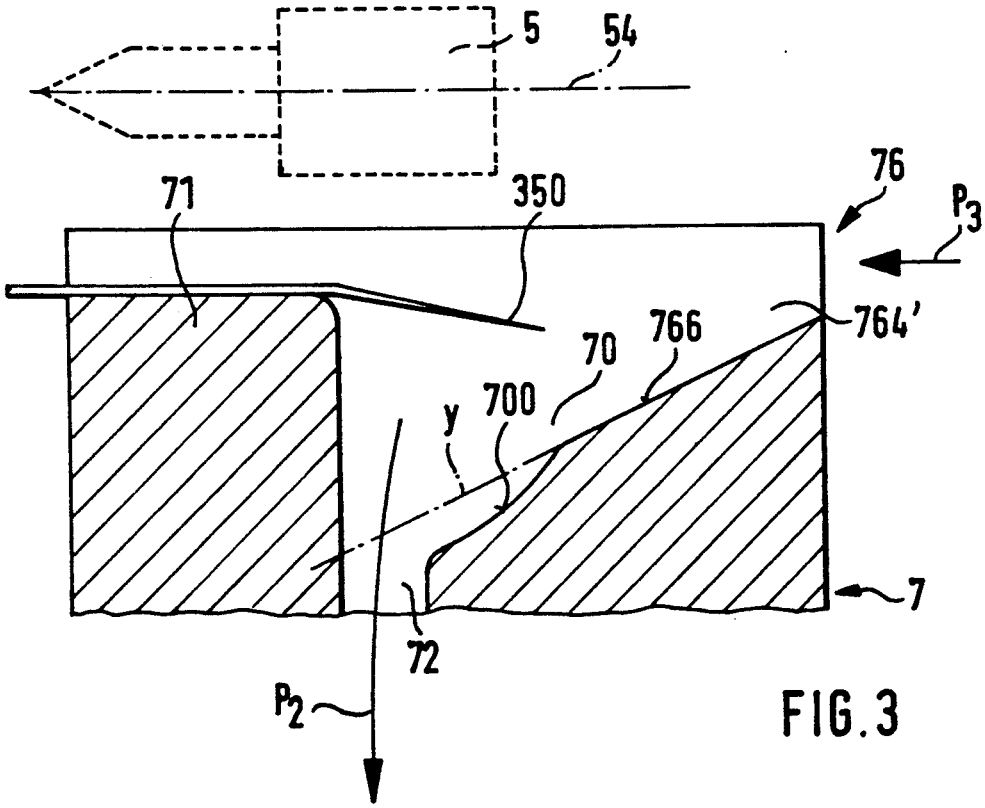
FIG. 3 is a longitudinal sectional view of a detail of another embodiment of a nozzle according to the invention.

The negative pressure produced in the bore 72 of nozzle 7 by the negative pressure prevailing in the spinning device produces a suction air flow in direction of arrow $P_2$ (as seen in FIG. 3). The yarn end 350 is now subjected to that flow. Because of the slit configuration of the yarn insertion groove 70 this suction air flow acts upon yarn end 350 only in the area of the yarn insertion groove 70.

As was already mentioned in connection with FIG. 2, the bottom 700 of the yarn insertion groove 70 is at a greater distance from the moving path 54 of the presenting device 5 than the yarn support 71. The yarn end 350, therefore, hangs freely in the air and can follow unhindered the suction air flow prevailing in the yarn insertion groove 70 in direction of arrow $P_2$ and thus enters the bore 72 of nozzle 7.

The presenting device 5 now returns in the direction of arrow $P_4$ (FIG. 1) and stops in the transfer position above the nozzle 7. At the same time yarn end 350 is sucked deeper and deeper into the yarn draw-off pipe 12 as a function of the pivoting motion of the presenting device 5. In the transfer position of the presenting device the yarn clamp 53 is opened so that yarn 35 is released by presenting device 5.

The yarn 35, which is sucked in direction of the fiber collection surface of the not-shown open-end spinning element, lies on the fibers which, in the meantime, have again been fed to the fiber collection surface, and for this a yarn reserve not shown) constituted previously during the back-feeding of yarn 35 into suction pipe 0, may have to be used up. Yarn draw-off is then the resumed in the known manner and yarn 35 is wound up on bobbin 31 which is again lowered on the winding roller 30 and separated from the auxiliary driving device 34 in the meantime. As a result of the centering device 41 being suitably driven in a direction opposite to the prior direction of rotation, which was needed to center yarn 35, the yarn 35 is moved over segment 411 to its free end in synchronization with the release and back-feeding of yarn 35, and is thrown off segment 411.

The yarn end 350 to be fed back to the spinning element can be prepared in a known manner for piecing. Cutting by means of a cutting device 8 can be quite sufficient, for example. But it may also be tapered in the conventional manner by means of a preparation device which is not shown here. Such a tapered yarn end 350 is shown in FIG. 3.

It goes without saying that if the spinning element is a rotating one, e.g., a spinning rotor, it must again be started up in coordination with the piecing process.

A comparison between FIGS. 2 and 3 shows that the yarn insertion groove 70 can be designed in different ways. In the embodiment shown in FIG. 2 the yarn insertion groove 70 has essentially a rectangular profile in cross-section, with the edges 73 and 74 which deflect yarn 35, and to which the transition edge into bore 72 of the nozzle 7 also belongs, being convex surfaces, i.e., have a rounded profile. It has been shown to be especially advantageous if these rounded edges 73 and 74 have a radius measuring from 0.5 to 1.5 mm. It has been shown that when radii are smaller, friction produced by the roughness of the yarn can become so great that reliable introduction of the yarn end 350 into bore 72 is no longer ensured. On the other hand, it has been shown that when the radius of edges 73 and 74 is too great, the enveloping friction has a detrimental effect and may also hinder or impede the insertion of the yarn end 350 into bore 72 of the nozzle 7. Depending on the material used, this may occur with radii greater than 1.5 mm.

As a rule, it is desirable to coordinate the length of the yarn end 350 by suitable selection of the cutting position of the presenting device 5, on the one hand, with the length of the yarn end 350 in the area of nozzle 7 through suitable selection of the yarn inserting position of the presenting device 5 and, on the other hand, in such manner that the yarn end 350 extends from the yarn support 71 freely to above the yarn insertion groove 70. The yarn insertion groove 70 is of a length that is at least as great as the length of yarn 350 extending beyond the yarn support 71.

Depending on the material used, this goal can, however, not always be reached precisely without having to give nozzle 7 excessive dimensions. For example, if the yarn end 350 cut by means of the cutting device 8 must also undergo a preparation process to give yarn end 350 a tapered configuration, a somewhat greater yarn length must be fed back to the fiber collection surface than if yarn 35 is only shortened by cutting in order to achieve a sufficient strength in the piecing joint. In that case the yarn inserting position of the presenting device 5 must be selected so that yarn end 350 extends beyond the yarn insertion groove 70.

As mentioned above, the yarn insertion groove 70 is of such a dimension, and coordinated with the movement of the presenting device 5 in such a manner, that, normally, the yarn end 350 resting on the yarn support 71 hangs freely in the air above the yarn insertion groove 70. The yarn insertion groove 70 is, therefore, of such length and of such depth that yarn end 350 does not come into contact with the walls of the yarn insertion groove 70 as it is deflected in the direction of bore 72, excepting, at the most, the lateral walls of the yarn insertion groove 70 which guide the yarn end 350.

According to FIG. 3 the yarn insertion groove is provided with a curved bottom. The curve is such in that case, that bottom 700 of the yarn insertion groove 70 is essentially concentric with the end of the yarn support 71 towards the yarn insertion groove 70.

Figure 4:
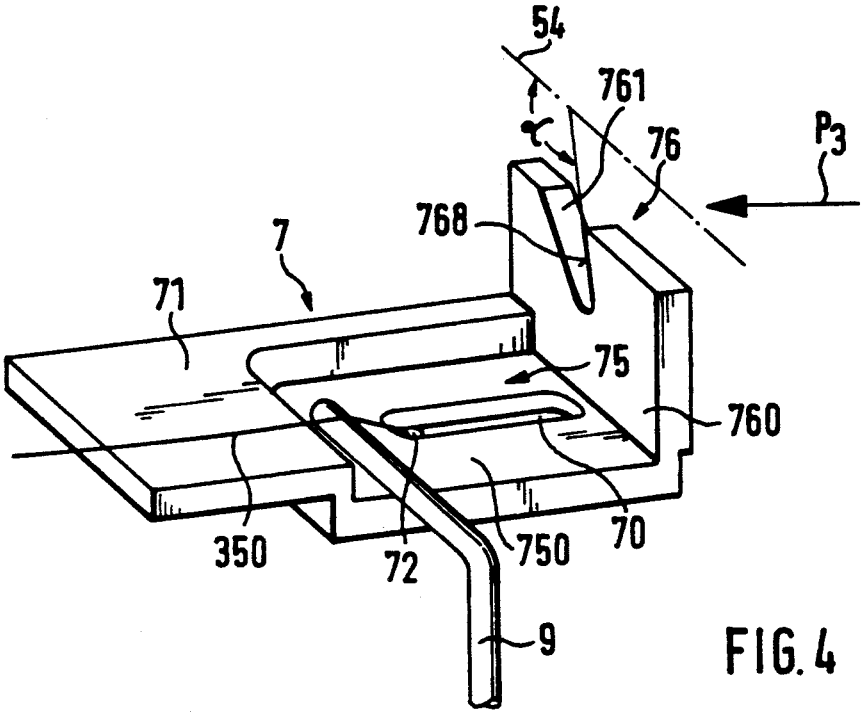
FIG. 4 is a perspective view of yet another embodiment of the nozzle according to the invention.

FIG. 4 shows a nozzle 7 provided with a recess 75 which, in turn, is provided with an opening 751 (see FIG. 7) on the side, so that a swivel-mounted yarn feeler 9 is able to reach into the recess 75 from the side. The yarn insertion groove 70 is provided in the bottom 750 of recess 75. Recess 75 reaches on its side away from the yarn support 71 at least as far as the yarn insertion groove 70. On its side towards the yarn support 71 the recess 75 extends so far beyond the yarn insertion groove 70 and bore 72 that the yarn feeler 9 is pivoted into its rest position and finds room between the yarn support 71 and the bore 72. The recess also has a depth h (see FIG. 5) which is greater than the sum of the diameter d or of the thickness of yarn feeler 9 and the distance a between said yarn feeler 9 and bottom 750 of recess 75. This ensures that the deflection of the yarn into the bore 72 of nozzle 7, and thereby also into the bore of the yarn draw-off pipe 12, can be carried out without being impaired by the yarn feeler 9, so that the latter can be installed in great proximity to the spinning element.

In the embodiment shown in FIGS. 4 to 6 and 8 a yarn guide 76 is installed before the yarn insertion groove 70 (with reference to the presenting movement (arrow $P_3$) of presenting device 5). Guide 76 ensures that the yarn end 350 is sucked into the yarn insertion groove 70 and into the range of concentrated suction air flow being aspired into bore 72.

In the example shown, a wall 760 is provided on the nozzle 7 on its side away from the presenting device 5 in yarn inserting position, the wall being oriented transversely to the direction of movement of said presenting device 5 (arrow $P_3$) in FIG. 4, the yarn guide being formed in said wall 760. It has the form of a notch 761 which tapers as its distance from the moving path 54 of the presenting device 5 increases.

FIG. 1 shows the presenting device 5 mounted on a pivoting axis 52. The presenting device 5 executes a circular movement, causing the position of yarn 35 in relation to the nozzle 7 to be changed also.

To ensure that yarn 35, extending from presenting device 5 to notch 761, gets into the yarn insertion groove 70, notch 761 is provided on the side away from the axis 52 of the presenting device 5, considering a plane e formed by bore 72 of nozzle 7 and the yarn insertion groove 70. The yarn guide 76 constituted by notch 761 is located at a greater distance from the axis 52 of the presenting device 5 than the end of yarn insertion groove 70 (FIG. 8) towards notch 761. This makes it possible for the course of the yarn to remain in the zone of influence of the suction air stream applied to the yarn draw-off pipe 12 in spite of the circular path of the presenting device 5, even when the latter has reached its yarn inserting position. This suction air stream can act with special intensity on the yarn end 350 when the connecting line 35*a* between the yarn guide 76 in form of notch 761 and the presenting device 5 intersects the plane or surface e which is defined by bore 72 (or by the end of yarn draw-off pipe 12 towards the moving path 54 of the presenting device 5) and the yarn insertion groove 70 in the longitudinal zone of yarn insertion groove 70. This ensures that the yarn end 350 will still extend beyond the yarn insertion groove 70, even when it has passed presenting device 5 and nozzle 7 and is brought into its yarn inserting position, so that yarn end 350 is certain to enter yarn insertion groove 70 and also yarn draw-off pipe 12 after leaving notch 761. It goes without saying that this offset of the yarn guide 76, which may be in form of a notch 761 for example, must be greater or smaller depending on the position in which it is built (in a horizontal or more or less inclined plane).

Figure 5:
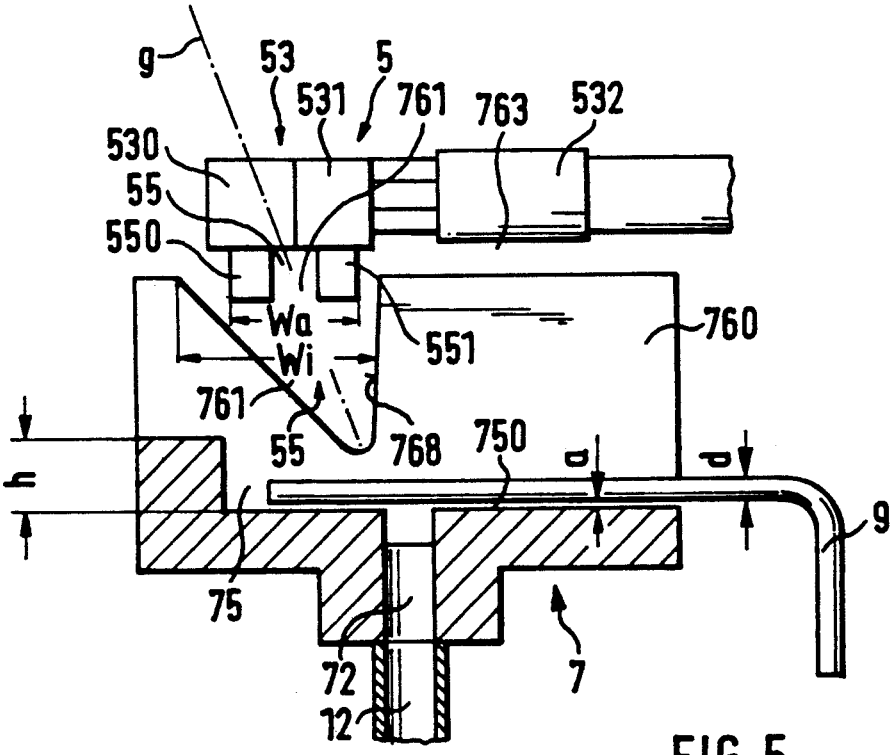
FIG. 5 is a cross-sectional view of a nozzle according to the invention, together with a presenting device designed according to the invention.
Figure 6:
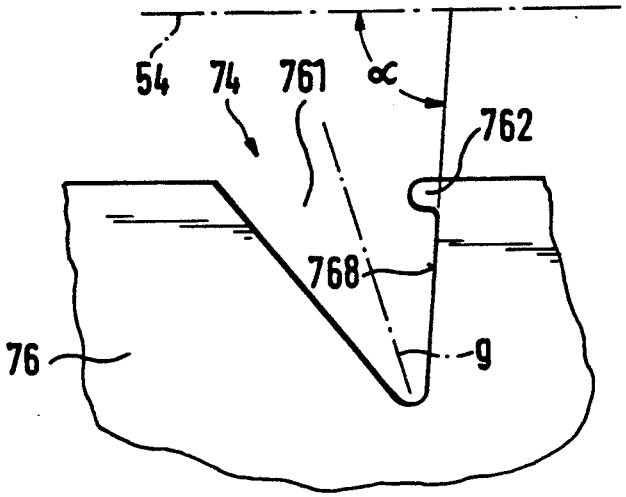
FIG. 6 is a side view of a modification of the nozzle shown in FIG. 5.

According to FIGS. 5 and 6 the notch 761 is of asymmetric design so that a straight line (center line g) cutting notch 761 in half is at such a slope that as the distance from the moving path 54 of presenting device 5 increases, it comes closer to its pivoting axis 52. In this way, the presenting device 5 pulls yarn 35 ever deeper into notch 761 as it moves into its yarn inserting position so that yarn 35 is secured in that position and is sure to enter the yarn insertion groove 70 with its yarn end 350.

The certainty with which yarn 35 is prevented from leaving notch 761 when this is not wanted can be further increased by inclining the lateral edge 768 of notch 761 towards the axis 52 of presenting device 5 in relation to the moving plane (moving path 54) of presenting device 5 so that the angle α between the plane lying in the moving path 54 of presenting device 5 and lateral edge 768 (as seen from the inside of notch 761) is not less than 85°, and preferably more than 90°. In addition it is possible to under cut this edge 768 and to provide it with a stop 762 which securely holds back yarn 35 so that yarn end 350 cannot leave notch 761 laterally, in the direction of the axis 52 of presenting device 5.

According to FIG. 5 the presenting device 5 is provided with a guide 55 consisting of two elements 550 and 551 on its side towards the nozzle 7 which are inserted through notch 761 when the presenting device 5 moves into its yarn inserting position. For that purpose, the maximum outside width $W_a$ of guide 55 is smaller than the clear or inside width $W_i$ of notch 761. Thanks to guide 55, the yarn end 350 is placed into groove 761 in which yarn end 350 is securely held due to the geometry of notch 761.

The guide 55 and the yarn guide 76 can be designed in different ways, e.g., in form of a groove, a notch, two bolts, etc. FIG. 3 shows that instead of a notch 761, a guiding groove 764 constituting yarn guide 76 and extending in the moving direction ($P_3$) of the presenting device 5 is located before the yarn insertion groove 70. In order to introduce the yarn end 350 securely into the guiding groove 764 when presenting device 5 is moved beyond nozzle 7, the guiding groove 764 can be widened in the manner of a funnel on its side away from the yarn inserting position of presenting device 5 (see widening 765 in FIG. 7).

When the presenting device 5 is designed with a guide 55, narrow tolerances must be observed to ensure that the guide can reliably pass through notch 761. FIG. 1 shows another embodiment in which the yarn is securely guided into notch 761 without the necessity of especially considering tolerances. According to FIG. 1 and elastic element in form of a lobe 763 extends from wall 760 which contains the yarn guide 76 (notch 761) preceding the yarn insertion groove 70 in the direction of the moving path 54 of presenting device 5. This lobe 763 ensures that yarn 35 is faultlessly inserted by presenting device 5 into notch 761.

Lobe 763 reaches at least as far as into proximity of the moving path 54 of presenting device 5, and in the shown, preferred embodiment, even as far as into the moving path 54 of presenting device 5, so that yarn end 350 has absolutely no other possibility than to enter notch 761.

The elastic element can also be designed differently, in form of an elastic pin. Instead of an elastic element, it is also possible to provide a retaining element which, although itself of rigid construction, is, however, mounted elastically so that it is able to evade the presenting device 5.

The bottom 766 of guiding groove 764 (see FIG. 3) need not extend parallel to the moving path 54 of presenting device 5. The feeding of yarn end 350 to yarn insertion groove 70 and bore 72 of nozzle 7 is facilitated if the bottom 766 is at a shorter distance from the moving path 54 of presenting device 5 on its side away from the yarn inserting position of presenting device 5 than on its side towards the yarn inserting position. If the bottom 766 slopes down in direction of bore 72, this facilitates the insertion of yarn end 350 into bore 72, while the deflection of yarn end 350 in direction of yarn insertion groove 70 can start before the presenting device 5 has reached its end position, i.e., its yarn inserting position. A design (see FIG. 3) in which the bottom 766 of guiding groove 764 follows essentially the connecting line y between the end 764' of the guiding groove 764 away from the yarn inserting position of presenting device 5 and the opening of the pipe-shaped element (e.g., yarn draw-off pipe 12) towards the moving path 54 of presenting device 5, whereby bore 72 of nozzle 7 can take the place of this opening, has been found to be especially advantageous.

As the preceding description shows, the spinning device can be modified in many different ways within the framework of the instant invention. It is, for example, possible to replace certain characteristics by equivalents or to combine them in a different manner with additional characteristics. Neither is it absolutely necessary for the pipe-shaped element, which can be subjected to negative pressure, to be in form of a yarn draw-off pipe 12 of an open-end spinning device. If a spinning or twisting device with a pneumatic twisting element is involved, the latter or part thereof, can constitute the pipe-shaped element in the sense of the instant invention. Several individual yarns can be twisted together in a known manner by means of this twisting element, or a twisted yarn can be produced in that a drawn fiber sliver is twisted by the twisting element and maintained in the twisted state through the incorporation of fibers previously spread away.

It is necessary with such a spinning device, as well as with a twisting device, to feed the twisted or spun yarn back to the twisting element when the yarn has broken for piecing purposes. In order to be able to subject this twisting element to negative pressure, it is either provided with compressed-air bores or jets inclined in the direction opposite to that of the normal yarn draw-off, or else an element capable of being subjected to negative pressure can be attached to the side of the twisting element which constitutes its feeding side during normal production to suck back the yarn end.

Here, too, the same problems exist as for back-feeding of the yarn 35 into the yarn draw-off pipe 12 of an open-end spinning machine. Therefore, a presenting device 5 as well as a nozzle 7 of the type described can also be used with such a twisting or spinning device with a pipe-shaped spinning or twisting element capable of being subjected to negative pressure, i.e., a pneumatic twisting element.

The device can be designed so that the elements of the spinning o twisting device required for work during normal production (twisting or spinning) are installed at every work station. However, the elements which are needed only to initiate the normal working process, e.g., piecing, can be installed on a service unit capable of traveling alongside a plurality of work stations of the same type.

If, however, only one work station is provided, for example, in a testing device, it goes without saying that the elements needed for the normal operation as well as for the start-up must be installed at the work station itself.

The presenting device 5 can also be of different design and move in a different manner than shown. It can, for example, be capable of pivoting around a horizontal axis instead, as shown, around a vertical axis; however, it can also be mounted in a slid-like guide run so that it can be shifted. Depending on the type of movement of presenting device 5 (linear or circular), the surface 4 can be flat or curved.

The yarn clamp 53 can also be made differently, e.g., in the form of two rollers that are driven in the direction of rotation, or, also, in the form of one roller capable of being driven and one non-rotating counter-piece. Instead of a yarn clamp 53 it is, however, also possible to provide a sieve which can be subjected to negative pressure so that yarn 35 is sucked by the negative pressure against the sieve and thus held for as long as the negative pressure is maintained.

The cutting device 8 can also be made differently, e.g., in the manner of scissors.

In the embodiment shown in FIG. 2, the yarn support 71 is made in the form of a clamping element towards which another clamping element 710 can be brought and which can be moved parallel to the moving path 54 of presenting device 5.

This additional clamping element 710 is made in form of an elastic lobe in the embodiment shown. Other designs, e.g., in form of a band loop made of rubber, or in form of a rigid or only slightly deformable block or plate-shaped, elastically mounted stop are also possible.

By means of such clamping elements 71 and 710 it is possible to use nozzle 7 also with mass piecing when a plurality of adjoining spinning stations of the same type are stopped together and are again pieced together.

When this plurality of work stations (spinning or twisting stations) are stopped, the different elements of this work station are stopped in a known, synchronized manner so that the yarn ends 350 are pulled out at least to a great extent from the yarn draw-off pipe 12 or other ring-shaped element at the different work stations. To ensure that the yarn end 350 cannot leave this position during the stoppage of the machine, when the pipe-shaped element is not subjected to negative pressure, the mobile clamping element 710 is moved in direction of arrow $P_3$ beyond nozzle 7 and is brought to bear against the clamping element (yarn support 71).

When the machine is to be started up again after a pause, the different elements of the work stations are switched on one after the other in a known, synchronized manner. In coordination therewith, the clamping element 710 also returns into its rest position where it is outside the moving path 54 of presenting device 5. The free yarn end 350 which is in the area of influence of the reactivated suction air stream of the pipe-shaped element is sucked into same so that the subsequent operation takes place in the known manner.

Since the clamping element 710 liberates the moving path 54 of presenting device 5 during piecing, the latter can operate in the manner described when disturbances occur, without being hindered by the clamping element 710.

Figure 7:
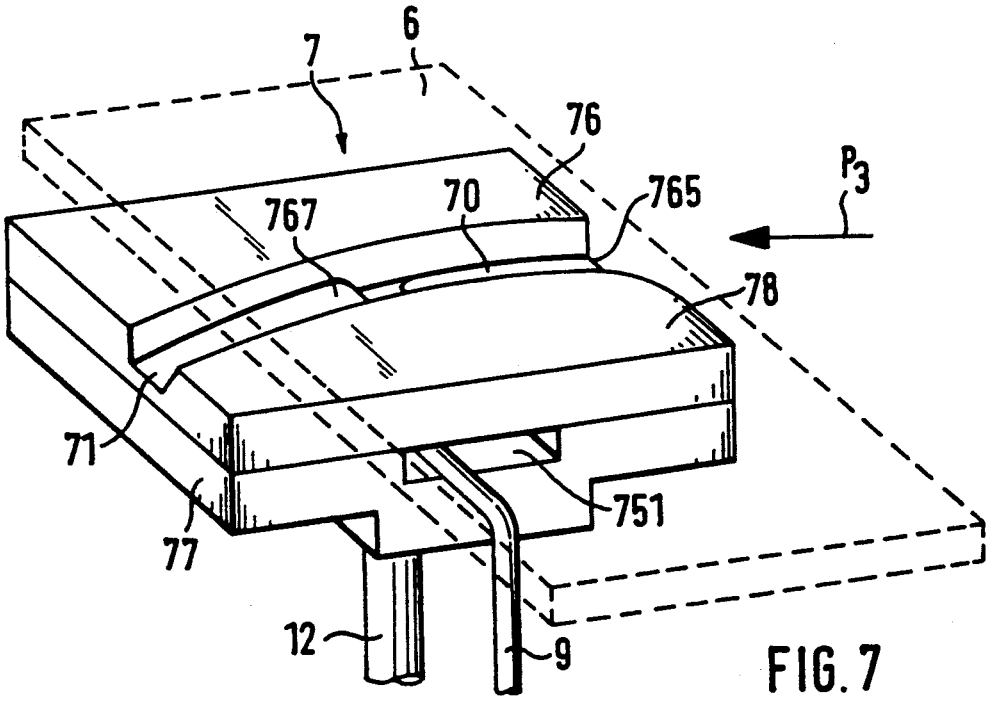
FIG. 7 is a perspective view of yet another variant of a nozzle according to the invention.
Figure 8:
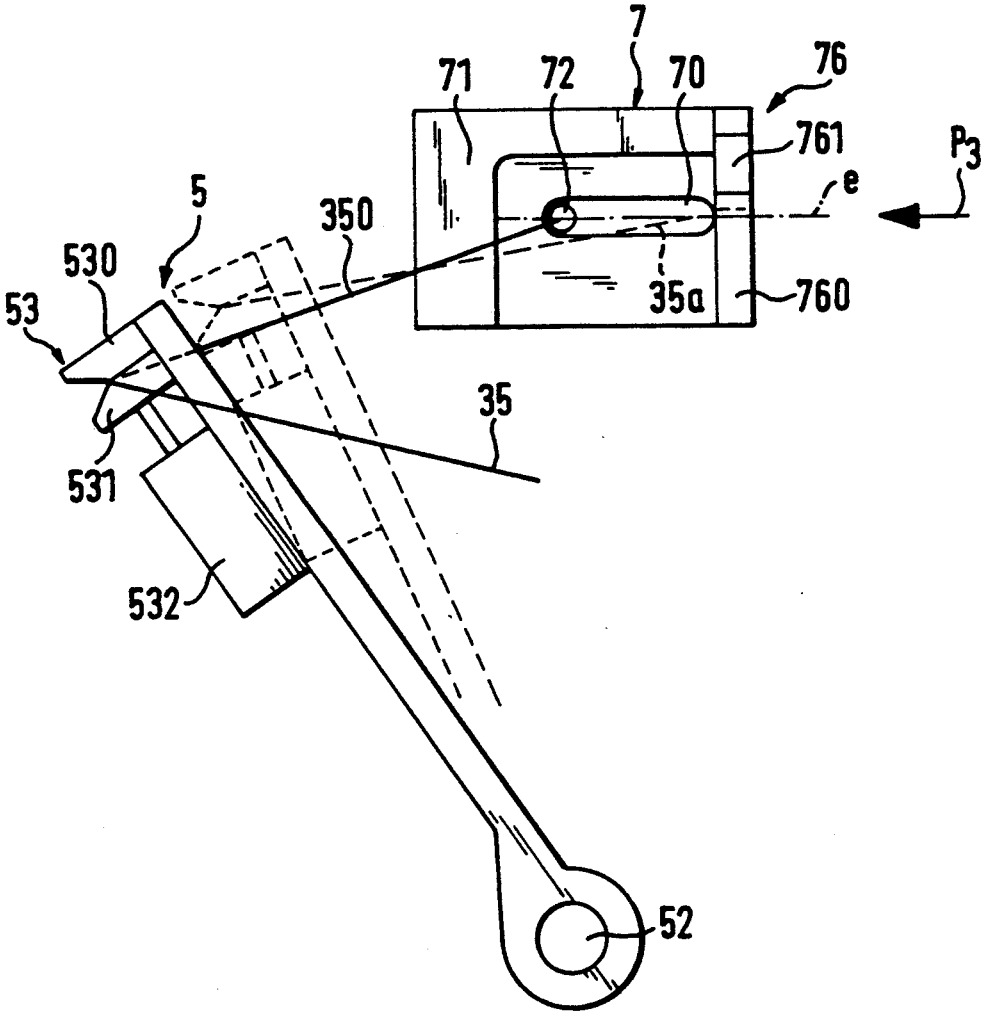
FIG. 8 is a top view of a presenting device and of a nozzle according to the invention.

FIG. 7 shows another embodiment of a nozzle. The nozzle 7 in this embodiment is made in two parts and consists of a lower part 77 which receives the recess 75 as well as the yarn insertion groove 70, and of a cover-like upper part 78 in which a guiding groove 767 is located which extends (in relation to the moving direction of the presenting device 5 in its yarn inserting position indicated by arrow $P_3$) from the presenting end of nozzle 7 via yarn insertion groove 70 and beyond it, in the direction of the yarn inserting position of presenting device 5, to the removing end of nozzle 7. The guiding groove 767 verges into the yarn insertion groove 70 and the yarn support 71 is constituted by the bottom of guiding groove 767 and is, therefore, a part thereof.

In a similar manner it is also possible, in order to repair a yarn breakage, for the presenting device 5 to pull the yarn end 350 over and beyond bore 72 so that yarn end 350 is sucked back into bore 72 only with the return movement of presenting device 5. For this it is merely necessary that an appropriate configuration of the nozzle 7 causes the suction air stream to be of such intensity in the area of yarn end 350 that it is able to pull yarn end 350 back. For that reason deflection edges near the yarn support 71 must be designed in the same manner as the edges 73 and 74 (see FIG. 2).

In order to reduce retention of the yarn end 350 at nozzle 7 as much as possible, the friction values, adhesion values, etc., must be lowered. This is achieved first of all by giving the appropriate configuration to the surfaces, edges and profiles (of the grooves) of nozzle 7 which come into contact with the yarn end 350. In addition to the selection of an appropriate configuration for the surfaces, and edges coming into contact with the yarn end 350, the material also plays a major role. It is advantageous if at least the part of nozzle 7 which receives the yarn insertion groove 70 and extends to bore 72 is made of a synthetic material which cannot be statically charged. To achieve this, the yarn insertion groove 70 can be located in an insert of nozzle 7, or the basic body of nozzle 7 can be made of such a synthetic material while the support parts are made of a different material. An embodiment shall be described further below through FIG. 7. It can also be advantageous for the yarn support 71 to be made similarly of such a non-chargeable synthetic material.

Another possibility to intensify the air flow in the area of bore 72 (see FIG. 5) and, in particular, of the yarn insertion groove 70 or of the guiding groove 767 is indicated by broken lines in FIG. 7, whereby the guiding groove can be covered by a cover 6. This cover 6 is normally located outside the moving path 54 of presenting device 5 and is brought to the nozzle 7 once the presenting device 5 has passed nozzle 7.

Cover 6 can be controlled as desired for that purpose, e.g., by the control device (not shown) which also controls the entire piecing process (in open-end spinning devices). However, it can also be coupled to presenting device 5 for movement, and when the presenting device 5, being pivoted away from its starting position, has arrived to a location above the nozzle, it can be uncoupled so that the presenting device 5 alone continues into its yarn inserting position while cover 6 remains at nozzle 7 and covers it. As the presenting device 5 is pivoted back, the cover 6 is again coupled to presenting device 5.

It is, however, also possible to have the presenting device 5 actuate a switch or a rod system after passing nozzle 7 (in its movement into yarn inserting position), causing cover 6 to be brought from its rest position into its operating position in which it covers nozzle 7. The actuation of the switch or of the rod system is carried out as a function of the presenting device 5 at the earliest when the latter has passed the nozzle 7 in the direction of yarn inserting position, and at the latest when presenting device 5 has reached its yarn inserting position. Inversely, the presenting device 5 causes the opening of the nozzle 7 in its return movement in a time-coordinated manner so that when presenting device 5 reaches nozzle 7, the cover 6 has again opened the moving path 54 of presenting device 5.

As shown in FIG. 7, the recess 75 (see FIG. 4) can be covered by a cover-like part 78 on its side towards the moving path 54 of presenting device 5 so that recess 78 is closed like a chamber in nozzle 7. The side of the cover-like part 78 of the nozzle 7 towards the moving path 54 of presenting device 5 is then intersected by the guiding groove 767 extending on either side of the yarn insertion groove 70. The cover of the chamber-like recess 75 in turn causes intensification of the air flow in the area of yarn insertion groove 70 and also of guiding groove 767.

The nozzle 7 can, in principle, be connected as desired to the yarn draw-off pipe 12 or to some other pipe-shaped element. So that the tolerances to be observed need not be too narrow, provisions are made according to FIG. 2 for the nozzle 7 to be merely connected interlockingly to the yarn draw-off pipe 12 or other kind of pipe-shaped element, e.g., by a catch or clip connection 120 that can be opened rapidly if necessary. To improve the hold of the nozzle 7 the latter can, in addition (or instead), be connected in a similar manner (i.e., by means of a detachable catch or clip connection 110) to the cover 10 or 11.

We claim:

1. Means for recovering and back-feeding broken yarn on apparatus for producing yarn, which apparatus has a yarn-producing element, a pipe-shaped element having a bore for guiding yarn produced to and from said yarn-producing element, a mouth at an outer end of said pipe-shaped element having an axis and means for collecting yarn produced by said yarn-producing element, said recovering means comprising:

(a) means for recovering a broken yarn end from said yarn collecting means and for guiding said yarn end to a predetermined position;

(b) presenting means for gripping said recovered yarn end and presenting said yarn end by lateral movement to said outer end of said pipe-shaped element;

(c) means for cutting said yarn between said recovering means and said preventing means a predetermined length from said presenting means;

(d) means for moving said presenting means along a predetermined path to adjacent the mouth of said pipe-shaped element, said predetermined path being perpendicular to said axis of said mouth of said pipe-shaped element;

(e) an elongated nozzle disposed on said outer end of said pipe-shaped element having an elongated groove in pneumatic communication with said pipe-shaped element, said elongated groove extending parallel to said predetermined path of said presenting means and perpendicular to the axis of said mouth of said pipe-shaped element so that said presenting means guides said predetermined length of yarn end over and past said mouth of said pipe-shaped element with said length of yarn end initially entering said elongated groove and being oriented therein generally transversely to said axis of said mouth thereby ensuring said yarn end is positively guided to said mouth; and (f) means for creating a negative pressure within said pipe-shaped element and said nozzle for drawing said broken yarn end initially into and through said elongated groove and for drawing said yarn end into said pipe-shaped element and back to said yarn-producing element for piecing, said elongated groove providing a generally frictionless and unobstructed path for said yarn end into said pipe-shaped element.

2. Recovering means as set forth in claim 1, wherein said elongated groove in said nozzle verges with said bore of said pipe-shaped element at a convex surface.

3. Recovering means as set forth in claim 2, wherein the radius of said convex surface is between 0.15 and 1.5 mm.

4. Recovering means as set forth in claim 1, wherein said elongated groove is of a length at least as great as said predetermined yarn length extending from said presenting means after said yarn is cut by said cutting means.

5. Recovering means as set forth in claim 1, wherein said elongated groove has a concave bottom extending substantially concentrically towards said bore.

6. Recovering means as set forth in claim 1, further comprises a yarn guide is disposed adjacent to one end of said elongated groove for guiding said yarn end into said elongated groove.

7. Recovering means as set forth in claim 6, wherein said yarn guide comprises a wall which extends substantially transverse to said predetermined path of said presenting means in a plane which intersects said predetermined path and comprises a notch for guiding said yarn end.

8. Recovering means as set forth in claim 7, wherein said notch has a predetermined width and wherein said predetermined means includes a gripping means having a width which is less than the width of said notch in said wall thereby permitting said gripping means to move through said notch as said presenting means moves along said predetermined path.

9. Recovering means as set forth in claim 7, wherein said presenting means is pivoted about an axis which is substantially parallel to said outer end of said pipe-shaped element and said notch is asymmetric and is disposed so that its imaginary center line approaches said axis as its distance from said predetermined path of said presenting means increases.

10. Recovering means as set forth in claim 9, wherein an edge is provided on said notch adjacent said axis of said presenting means and forms an angle with said predetermined path which is at least 85°.

11. Recovering means as set forth in claim 10, wherein said angler is greater than 90°.

12. Recovering means as set forth in claim 9, wherein an edge of said notch adjacent said axis about which said presenting means is pivoted is undercut.

13. Recovering means as set forth in claim 6, wherein said yarn guide comprises a guiding groove extending along said predetermined path of said presenting means.

14. Recovering means as set forth in claim 13, wherein said guiding groove is wider remote from said mouth of said bore in said pipe-shaped element.

15. Recovering means as set forth in claim 13, wherein said guiding groove is deeper at its side remote from said mouth of said bore in said pipe-shaped element.

16. Recovering means as set forth in claim 13, wherein said guiding groove extends beyond said elongated groove in said nozzle in the direction of said presenting means in its yarn insertion position.

17. Recovering means as set forth in claim 16, in which said presenting means is pivotally mounted about a pivot axis which is substantially parallel to said outer end of said pipe-shaped element supporting said nozzle wherein said yarn guide precedes said elongated groove having an end adjacent said yarn guide and is at a greater distance from said pivot axis of said presenting means than said end of said elongated groove adjacent said yarn guide.

18. Recovering means as set forth in claim 16, wherein said presenting means are pivoted about a pivot axis which is substantially parallel to said one end of said pipe-shaped element and said yarn guide comprises an elastic guide element.

19. Recovering means as set forth in claim 1, wherein said nozzle is provided with a recess in the bottom of which said elongated groove is disposed, said recess having a lateral opening along one side of said nozzle through which a free end of a pivoted yarn feeler extends for feeling the presence of said yarn.

20. Recovering means as set forth in claim 19, wherein said recess is chamber shaped and is covered on one side by a wall having said elongated groove disposed therein.

21. Recovering means as set forth in claim 19, comprising a cover for said nozzle with said recess which is movable towards and away from said nozzle.

22. Recovering means as set forth in claim 21, wherein said cover movement is controlled by said presenting means as a function of its position.

23. Recovering means as set forth in claim 1, wherein said nozzle is supported by a yarn support made in the form of a clamping element and further comprises a clamping element which moves substantially parallel to said predetermined path of said presenting means.

24. Recovering means as set forth in claim 1, wherein said nozzle is composed of a synthetic material which does not retain a static charge.

25. Recovering means as set forth in claim 1, wherein said nozzle is releasably connected to said pipe-shaped element.

26. Recovering means as set forth in claim 25, wherein said nozzle is connected to said pipe-shaped element by means of a catch connection.

27. Recovering means as set forth in claim 1, wherein said apparatus for producing yarns is an open-end spinning device.

* * * * *